US007163454B2

(12) United States Patent
Carter

(10) Patent No.: US 7,163,454 B2
(45) Date of Patent: Jan. 16, 2007

(54) SYSTEM AND METHOD FOR MANAGING DISPENSATION AND RECONCILIATION OF COINS

(75) Inventor: Kenneth Carter, Naples, FL (US)

(73) Assignee: Balance Innovations, LLC, Lenexa, KS (US)

( * ) Notice: Subject to any disclaimer, the term of this patent is extended or adjusted under 35 U.S.C. 154(b) by 163 days.

(21) Appl. No.: 10/818,973

(22) Filed: Apr. 5, 2004

(65) Prior Publication Data

US 2004/0231955 A1 Nov. 25, 2004

Related U.S. Application Data

(60) Provisional application No. 60/460,361, filed on Apr. 3, 2003.

(51) Int. Cl.
*G07D 9/00* (2006.01)
*G07D 9/06* (2006.01)

(52) U.S. Cl. ..... 453/16

(58) Field of Classification Search ..... 194/217, 194/350, 353; 453/1, 2, 16, 17, 63; 235/2, 235/4, 7 A, 130 R; 221/9, 13, 154, 288, 221/289, 6, 10, 11, 17, 191, 194; 193/DIG. 1, 193/DIG. 2; 141/162, 179, 183, 318, 358, 141/311 R, 351, 156, 157; 222/424.5, 426, 222/447, 449, 454; 902/8, 9, 11, 13, 14, 902/17

See application file for complete search history.

(56) References Cited

U.S. PATENT DOCUMENTS 1,419,338 A * 6/1922 Wieneke ..... 141/358
4,319,326 A 3/1982 Uchida
4,447,885 A 5/1984 Biss
4,495,627 A 1/1985 Nishimura
4,512,428 A 4/1985 Bullivant
4,522,275 A 6/1985 Anderson
4,532,641 A 7/1985 Nishimura
4,646,767 A 3/1987 Hikita
4,674,060 A 6/1987 Larkin (Continued)

FOREIGN PATENT DOCUMENTS

FR 2586840 3/1997

(Continued)

OTHER PUBLICATIONS

Twenty-First Century Hotel Systems, Twenty-First Century Inn System Procedures Manual vol. IV: Front Office System Training (1993).

*Primary Examiner*—Patrick Mackey
*Assistant Examiner*—Mark Beauchanie
(74) *Attorney, Agent, or Firm*—Spencer Fane Britt & Browne

(57) ABSTRACT

A system (10) and method for managing coin dispensation and reconciliation. The system (10) broadly comprises a controller logic, preferably in the form of a computer program stored on and executed by a computing device (14); a coin dispensing mechanism (16); and security package (22). The system (10) may be a configured for constructing cash drawers or coin canisters. In either case, the controller logic may receive input relating to past coin usage, analyzes the input to predict future coin usage, and transmits a control signal to the dispensing mechanism (16) to control dispensation of the coins based at least on part on the predicted future coin usage.

14 Claims, 8 Drawing Sheets

U.S. PATENT DOCUMENTS

| | | | | |
|---|---|---|---|---|
| 4,682,288 | A | 7/1987 | Taipale | |
| 4,752,874 | A | 6/1988 | Meyers | |
| 4,839,505 | A | 6/1989 | Bradt | |
| 4,868,489 | A | 9/1989 | Kowalski | |
| 4,967,576 | A | 11/1990 | Warfman | |
| 5,126,732 | A | 6/1992 | Mardon | |
| 5,128,862 | A | 7/1992 | Mueller | |
| 5,193,629 | A | 3/1993 | Lare | |
| 5,227,966 | A | 7/1993 | Ichiba | |
| 5,308,120 | A | 5/1994 | Thompson | |
| 5,366,404 | A | 11/1994 | Jones | |
| 5,396,417 | A | 3/1995 | Burks | |
| 5,397,264 | A | 3/1995 | Gross | |
| 5,564,546 | A | 10/1996 | Molbak | |
| 5,756,977 | A | 5/1998 | Biss | |
| 5,805,456 | A | 9/1998 | Higham | |
| 5,813,510 | A | 9/1998 | Rademacher | |
| 5,830,054 | A * | 11/1998 | Petri | 453/5 |
| 5,909,794 | A | 6/1999 | Molbak | |
| 5,913,399 | A | 6/1999 | Takemoto | |
| 5,943,655 | A | 8/1999 | Jacobson | |
| 5,944,162 | A | 8/1999 | Filiberti | |
| 5,947,257 | A | 9/1999 | Schwartz | |
| 5,954,576 | A | 9/1999 | Coulter | |
| 6,047,808 | A | 4/2000 | Neubarth | |
| 6,109,774 | A | 8/2000 | Holmes | |
| 6,196,913 | B1 * | 3/2001 | Geib et al. | 453/10 |
| 6,213,341 | B1 * | 4/2001 | Keith et al. | 141/358 |
| 6,328,149 | B1 | 12/2001 | Blad | |
| 6,494,776 | B1 | 12/2002 | Molbak | |
| 6,520,308 | B1 | 2/2003 | Martin | |
| 2001/0034203 | A1 * | 10/2001 | Geib et al. | 453/3 |
| 2003/0195037 | A1 * | 10/2003 | Vuong et al. | 463/29 |
| 2004/0181481 | A1 | 9/2004 | Carter | |
| 2004/0231956 | A1 * | 11/2004 | Adams et al. | 194/217 |

FOREIGN PATENT DOCUMENTS

| | | | |
|---|---|---|---|
| GB | 2269088 | A | 2/1994 |
| JP | 404088496 | A | 3/1992 |

* cited by examiner

SYSTEM AND METHOD FOR MANAGING DISPENSATION AND RECONCILIATION OF COINS

RELATED APPLICATIONS

This application claims the benefit of U.S. Application Ser. No. 60/460,361 filed Apr. 3, 2003, incorporated by reference herein.

BACKGROUND OF THE INVENTION

1. Field of the Invention

The present invention relates broadly to systems and methods for managing the release or dispensation of coins. More particularly, the present invention concerns a system and method for managing the release or dispensation of coins of one or more denominations into, for example, cash drawers or tills used by cashiers or coin canisters used in automated dispensing machines, wherein such management involves analyzing a variety of relevant factors in determining an appropriate number or value of coins to dispense, and also involves facilitating reconciliation of the coins dispensed from the system.

2. Description of the Prior Art

Grocery stores and other retail and wholesale business establishments that use cash registers to facilitate sales and other business transactions must regularly stock, "construct", or "rebuild" cash drawers, tills, or coin canisters with coins of various denominations for issuance to and use by cashiers, clerks, or other personnel or automated checkout machines, and must periodically or eventually reconcile or balance those same tills or canisters to ensure that the coins remaining therein accurately reflect sales or other transaction records.

Most businesses typically construct new tills by manually counting a number or value of coins of each particular denomination, and then adding the counted coins to the tills by hand. Similarly, most businesses reconcile used tills by manually removing the remaining coins of each denomination from the tills and counting the number or value of those coins by hand. Thus, it will be appreciated that stocking and reconciling tills is a time and labor intensive activity that may be repeated hundreds of times each day in larger stores. Furthermore, manual counting may result in errors, and when such errors occur it may be necessary to recount the coins in question. In an effort to save time, some businesses use only rolled coins when rebuilding tills. Unfortunately, this can substantially increase overall costs because banks normally charge between three and seven cents per coin roll.

Prior art systems and methods are known for automating some aspects of till construction and reconciliation, but suffer from a number of problems and disadvantages, including, for example, the continued requirement that accounting personnel manually perform many of the steps involved. These prior art system and methods therefore continue to be time and labor intensive and prone to miscounting errors. Another problem with prior art systems and methods of till construction and reconciliation is a need to repeatedly perform pick-ups (i.e., remove excess coins from the tills), loans (i.e., add extra coins to the tills for change-making purposes), or purchases of additional coins by the cashiers. As these activities typically involve several employees, the associated time and labor costs continue to be substantial.

In order to increase efficiency and cut costs, many businesses have installed substantially automated coin dispensing machines to supplement the cashier's regular till. In use, a cash register sends control signals to the coin dispensing machine, causing its automated dispensing machinery to dispense an appropriate amount of change from an internal, removable cannister. The cashier need only accept cash and change to his or her till and dispense cash therefrom. Unfortunately, the coins loaded into the coin dispensing machines are considered part of the till, requiring that the coin dispensing machines be reconciled along with the till when changing cashiers. This can be a time-consuming activity and is often impractical.

In another attempt to increase efficiency and cut costs, many businesses have installed unmanned, fully-automated self-checkout systems. Typically, a single employee will monitor a number of these self-checkout systems to identify or address any problems that users may encounter. Each self-checkout system uses automated dispensing machinery, including coin canisters, for accepting and dispensing both cash and coins. It is often very difficult, however, to monitor and maintain enough coins in the self-checkout system to transact business for long periods of time while accounting for and balancing the coins added during replenishment, the coins received from customers, and the coins dispensed to customers. Furthermore, while the self-checkout systems may increase efficiency and cut costs by reducing the number of cashiers, they have no effect on the time and labor costs associated with constructing and reconciling the canisters.

Additionally, it can often be extremely difficult to determine an appropriate or necessary number or value of coins to include when constructing tills or canisters, or how many loans or purchases of coins will likely be made during a given shift or day. Providing too few coins will result in more frequent loans or purchases of coins by cashiers, or require more frequent replenishment of the automated dispensing machinery. Providing too many coins may make reconciliation even more time consuming, and may raise security issues. Predicting the appropriate or necessary amount of coins to include when constructing tills or canisters is made even more difficult by the fact that needs may vary considerably over the course of any given day, week, or other time period, and may spike during holidays or weekends.

Due to these and other problems and disadvantages in the prior art, an improved system and method is needed for managing the dispensation of coins when constructing tills for use by cashiers or canisters for use in automated dispensing machinery.

SUMMARY OF THE INVENTION

The present invention overcomes the above-described and other problems and disadvantages in the prior art by providing a system and method for managing coin dispensation and facilitating reconciliation. Broadly, the present invention provides for substantially automated and controlled coin dispensation and reconciliation that substantially increases efficiency and reduces time and labor costs associated with constructing or replenishing cash drawers or tills for use by cashiers and coin canisters for use in substantially automated dispensing machinery associated with otherwise conventional tills and fully-automated self-checkout systems. Such management and control involves considering a variety of relevant factors in determining an appropriate number and value of coins to dispense, and also involves reconciling, balancing, or accounting for all coins provided to, received by, and dispensed from the system. The system broadly comprises a control logic in the form of a computer program stored on and executed by a computing device; a coin dispensing mechanism in the form of one of a first coin dispensing mechanism, which includes a chute attachment, a funnel attachment, and a canister carriage, a second coin dispensing mechanism specifically adapted for use with tills, or a third coin dispensing mechanism specifically adapted for use with canisters; and a security package.

The computer program is operable to receive input concerning past coin usage; analyze the input to predict, project, or otherwise determine future coin usage; and transmit an output or control signal for controlling the dispensation of the coins by the dispensing mechanism, wherein the number or value of coins dispensed is based upon the predicted coin usage.

The coin dispensing mechanism is adapted to receive output or control signals from the computer program and, in response thereto, release or dispense the prescribed number or value of coins The dispensing mechanisms also conveniently facilitates the transfer of those coins into the tills or canisters. The first coin dispensing mechanism is provided with various attachments to allow for adapting the first dispensing mechanism for use with tills or canisters, as desired. The first dispensing mechanism broadly includes a housing; a plurality of coin dispensers; the chute attachment or attachments; a plurality of flap lids; the funnel attachment; and the canister carriage. Each coin dispenser of the plurality of coin dispensers is adapted to receive, store, and dispense a number of coins of a particular denomination, and to release or dispense into the chute attachment a number of those coins when called upon to do so.

The chute attachment is adapted to hold or retain the coins released or dispensed by the coin dispensers, and to transfer or deposit those coins into one or more compartments of the till. The funnel attachment functions to adapt the dispensing mechanism to fill a canister rather than till compartments. The canister carriage is adapted to receive and retain the canisters in a proper or desired position for filling by the dispensing mechanism.

The second coin dispensing mechanism is specifically adapted for use with tills, and does not require the attachment or removal of special till-accommodating components such as the chute attachment. The third coin dispensing mechanism is specifically adapted for use with canisters, and does not require the attachment or removal of special canister-accommodating components such as the funnel attachment and cannister carriage. The second and third dispensing mechanisms are substantially similar to the first in most other major respects.

The security package enhances security of the coin dispensing mechanism and coins loaded therein by allowing for monitoring by a closed circuit television (CCTV) system adapted to record video images of the dispensing mechanism or particular portions thereof.

Thus, it will be appreciated that the system and method of the present invention provides a number of distinct advantages over the prior art, including, for example, providing for substantially automated and controlled coin dispensation and reconciliation that substantially increases efficiency and reduces time and labor costs associated with constructing or replenishing tills or canisters. Furthermore, by analyzing past coin usage data to determine an appropriate number or amount of coins to dispense, the system substantially reduces time and labor costs associated with coin shortages and resulting loans or purchases of coins by cashiers during their shifts. Additionally, the system advantageously further improves efficiency by linking the processes of dispensation and reconciliation and treating them as necessary corollaries rather than wholly independent activities.

These and other important aspects of the present invention are more fully described in the section entitled DETAILED DESCRIPTION OF A PREFERRED EMBODIMENT, below.

BRIEF DESCRIPTION OF THE DRAWING FIGURES

A preferred embodiment of the present invention is described in detail below with reference to the attached drawing figures, wherein.

DETAILED DESCRIPTION OF A PREFERRED EMBODIMENT

Figure 1:
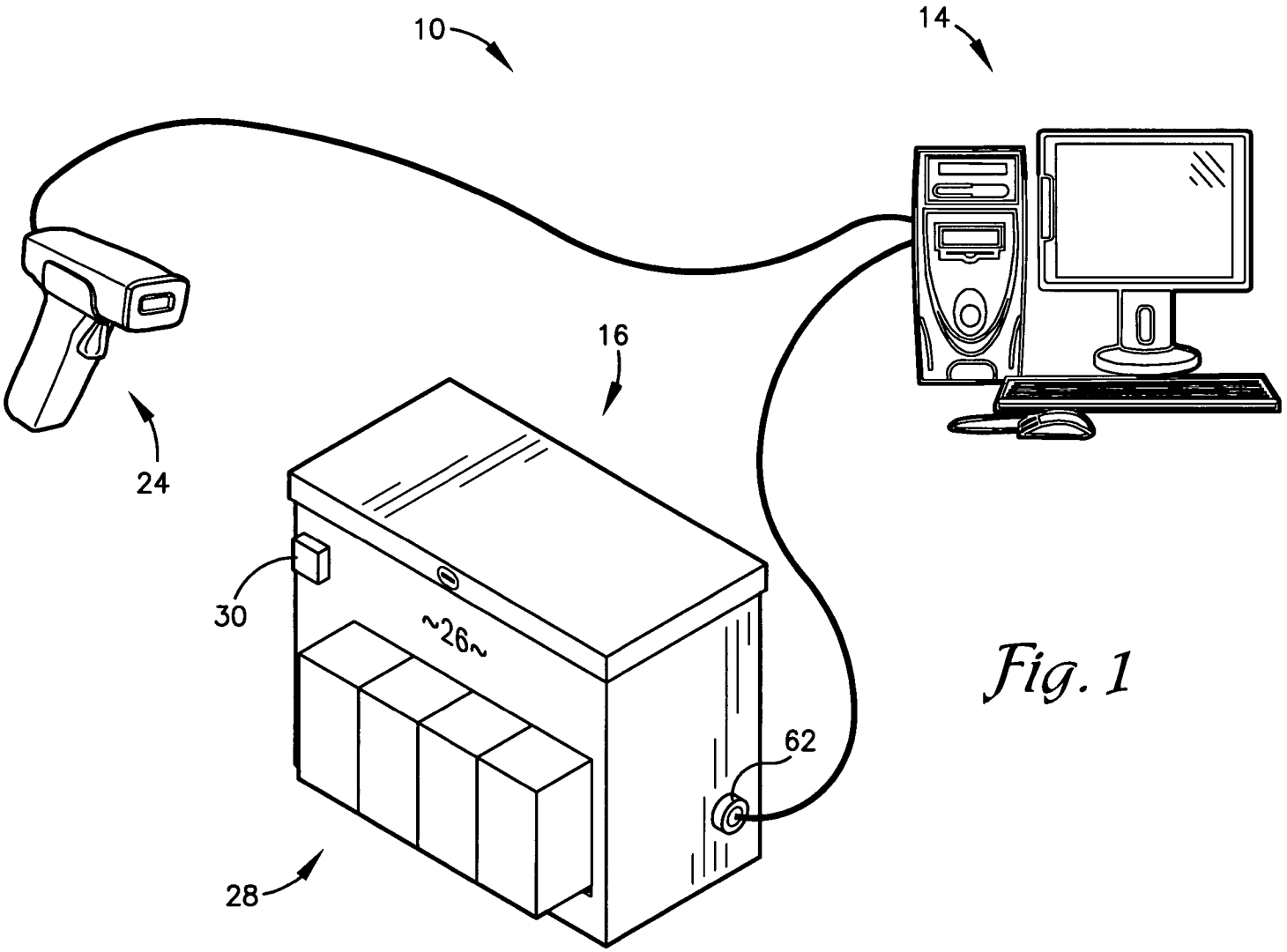
FIG. 1 is a high-level depiction of a preferred embodiment of the system of the present invention.
Figure 2:
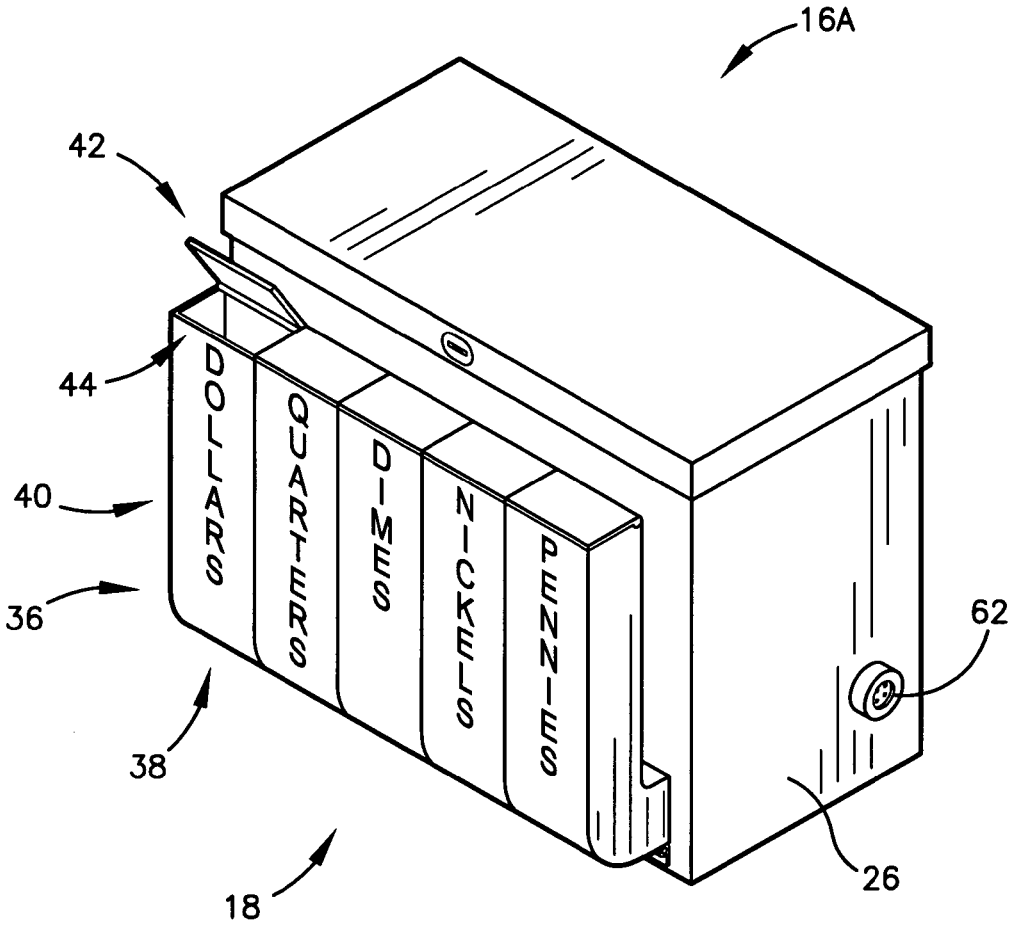
FIG. 2 is an isometric view of a first coin dispensing mechanism component for use with the system of FIG. 1, shown with a chute attachment subcomponent shown in a raised position.
Figure 3:
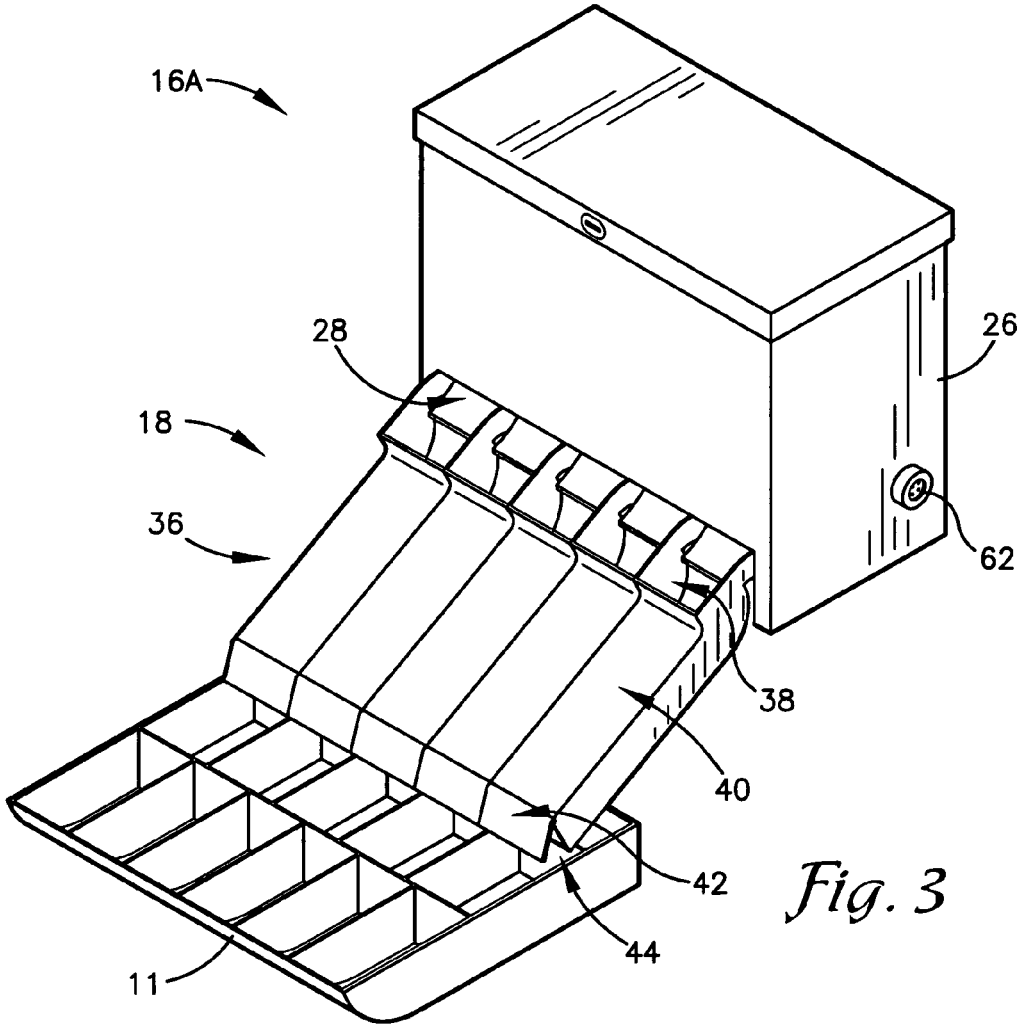
FIG. 3 is an isometric view of the first coin dispensing mechanism component of FIG. 2, with the chute attachment subcomponent shown in a lowered position.

With reference to the figures, a system 10 and method for managing coin dispensation and reconciliation is disclosed, shown, and otherwise described in accordance with a preferred embodiment of the present invention. Broadly, the present invention provides for substantially automated and controlled coin dispensation and reconciliation that substantially increases efficiency and reduces time and labor costs associated with constructing or replenishing cash drawers or tills 11 for use by cashiers or coin canisters 12 for use in automated coin dispensing machinery. The system 10 considers a variety of relevant factors in determining an appropriate number or value of coins to dispense, and, preferably, the system 10 facilitates reconciliation through substantially automatic record-keeping of all coins dispensed. In a preferred embodiment, referring to FIG. 1, the system 10 broadly comprises a controller logic, preferably in the form of a computer program stored on and executed by a computing device 14; a coin dispensing mechanism 16, which may take the form of a first coin dispensing mechanism 16A (shown in FIGS. 2–5), which includes a chute attachment 18, a funnel attachment 20, and a canister carriage 22, a second coin dispensing mechanism 16B specifically adapted for use with tills 11 (shown in FIGS. 6 and 7), or a third coin dispensing mechanism 16C specifically adapted for use with canisters 12 (shown in FIGS. 8 and 9); and a security package 24.

The computer program implementing the controller logic is operable to receive input concerning past coin usage; analyze the input to prospectively determine, project, or otherwise predict future coin usage; and transmit an output or control signal for controlling the release or dispensation of the coins by the coin dispensing mechanism 16, wherein the number or value of coins dispensed is based upon the predicted future coin usage. For example, the computer program may analyze input concerning a past coin dispensation, the number of loans or purchases performed to supplement that dispensation, and the number or value of coins reconciled. Other factors might include, for example, past and projected sales volume per time period and day; past and projected percentage of cash transactions; past and projected numbers of checks written for amounts greater than the amount of purchase (with the difference being returned to the purchaser in cash) or other cash-back transactions, if any; and the length of time cashiers or clerks will or are expected to work from the same till. If this information is properly analyzed over time, for a variety of times, days, and seasons, it becomes possible to predict future coin usage. Thus, it may be determined, for example, that coin usage increases dramatically during the hours of 11:00 am–1:00 pm and after 4:00 pm on weekdays and during the hours of 12:00 am–7:00 pm on Saturdays, Sundays, and holidays, in which case tills constructed for or during these times should be provided with increased amounts of coins in order to avoid more frequent loans or purchases by cashiers or other disruptions to replenish dwindling coin supplies.

A suitable computer program able or readily adaptable to perform the aforementioned functions is disclosed and described in a pending U.S. non-provisional patent application titled "REVENUE BALANCING METHOD AND COMPUTER PROGRAM", Ser. No. 09/616,401, filed Jul. 14, 2000. Alternatively, any suitable computer program may be used, adapted, or created to perform the aforementioned functions. Programming attendant to such adaptations or creation is considered to be within the abilities of one with ordinary skill in the computer programming arts given the description set forth herein.

The controller logic may alternatively be implemented in hardware, firmware, software, or any combination thereof. In the preferred software or computer program implementation, the controller logic is stored on a computer readable memory and executed by the computing device 14. The computing device 14 may be any conventional computing device, including, for example, a personal desktop or portable computer or a server, having sufficient computing resources (e.g., processing speed, memory) and ability to support the computer program.

The coin dispensing mechanism 16 is adapted to receive output or control signals from the computer program or other controller logic and, in response thereto, release or dispense the number or value of coins prescribed thereby. The dispensing mechanism 16 also conveniently facilitates the transfer of those coins into the till 11 or canister 12. The coin dispensing mechanism 16 broadly includes a housing 26 and a plurality of coin dispensers 28.

The housing 26 is adapted to secure and protect both the coin dispensers 28 and the coins loaded within the coin dispensers 28. The housing 26 may take any suitable shape or form and may be constructed of any suitable material, such as, for example, metal (e.g., steel or aluminum), high-impact plastic, or any of a wide variety of composite materials.

Each coin dispenser of the plurality of coin dispensers 28 is adapted to receive, store, and dispense a number of coins of a particular denomination, and to release or dispense into the chute attachment 18 a number of those coins when called upon to do so. As desired, the coin dispensers 28 may be any substantially conventional and commercially available coin dispensers, or may be particularly designed or adapted for use in the system 10 of the present invention. Dispensation preferably occurs as a result of an electronic signal generated by the computer program. Alternatively, the computer program may merely communicate (by way of, e.g., a visual or audible indicator) the need for dispensation, in response to which another action, such as mechanical actuation, is required to affect the dispensation.

Additionally, a code scanner 30 may also be incorporated into the coin dispensing mechanism 16 to allow for reading bar and other types of codes that may be associated with bags or other containers of coins, tills 11, or canisters 12 for easier identification. The code scanner 30 is preferably small in size and may be located in substantially any suitable location on or in the coin dispensing mechanism 16. A suitable scanner is available, for example, from PSC Inc. as the model LM-500+.

The coin dispensing mechanism 16 may take the form of the first coin dispensing mechanism 16A, shown in FIGS. 2–5, which is adaptable for use with tills or canisters, as desired. To accomplish such adaptation, the first dispensing mechanism 16A includes, as mentioned, the chute attachment 18, the funnel attachment 20, and the canister carriage 22.

The chute attachment 18 is adapted to hold or retain the coins released or dispensed by the coin dispensers 28, and to transfer or deposit those coins into one or more compartments of the till 11. The chute attachment 18 preferably includes a plurality of chutes 36, including one chute for each common coin denomination (i.e., penny, nickel, dime, quarter, dollar), with each chute 36 being associated with a particular one of the coin dispensers 28. It will be appreciated that a different number of coin dispensers and chutes may be needed to accommodate foreign currencies. Each chute 36 includes a cup portion 38, a slide portion 40, and a flap lid 42, and is pivotably coupled with the housing 26 or with the respective coin dispenser 28. The slide portion 40 includes an exit end 44 wherefrom the coins may issue, with the exit end 44 being sized to at least approximately correspond to a corresponding compartment of the till 11. In a first pivot position, shown in FIG. 2, the slide portion 40 is oriented substantially upward so that coins released or dispensed by the coin dispenser 28 are received and held within the cup portion 38 and cannot proceed down the slide portion 40. In a second pivot position, shown in FIG. 3, the slide portion 40 is oriented substantially downward so that gravity causes coins held in the cup portion 38 to proceed down the slide portion 40 and into the corresponding compartment of the till 11.

The one or more flap lids 42 are each associated with a respective one of the slide portions 40, being pivotably coupled with the exit end 44 thereof so as to substantially impede or slow the flow of the coins into the till 11. Each flap lid 42 may be spring-loaded or otherwise adapted so as to require manual actuation in order to allow any coins to issue, thereby avoiding accidental or premature release of the coins. Alternatively, each flap lid 42 may pivot freely, requiring no manual actuation, such that the mere weight and positioning of the flap lid 42 functions to slow the coins' release but not to prevent it altogether, thereby avoiding any sudden or uncontrolled rush of coins that could result in spillage.

Figure 4:
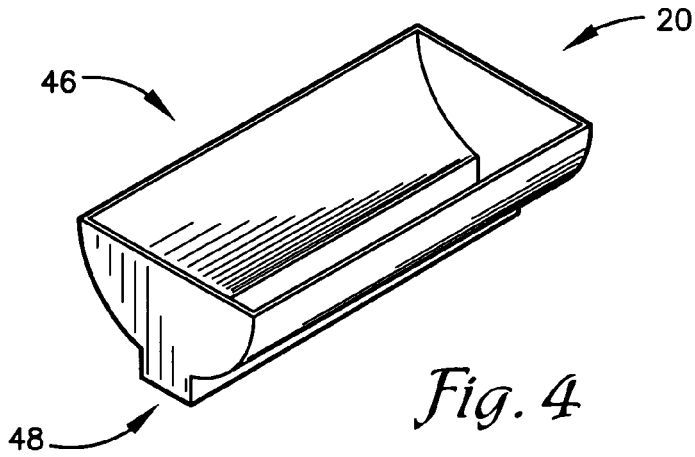
FIG. 4 is an isometric view of a funnel subcomponent for use with the first coin dispensing mechanism of FIG. 2.
Figure 5:
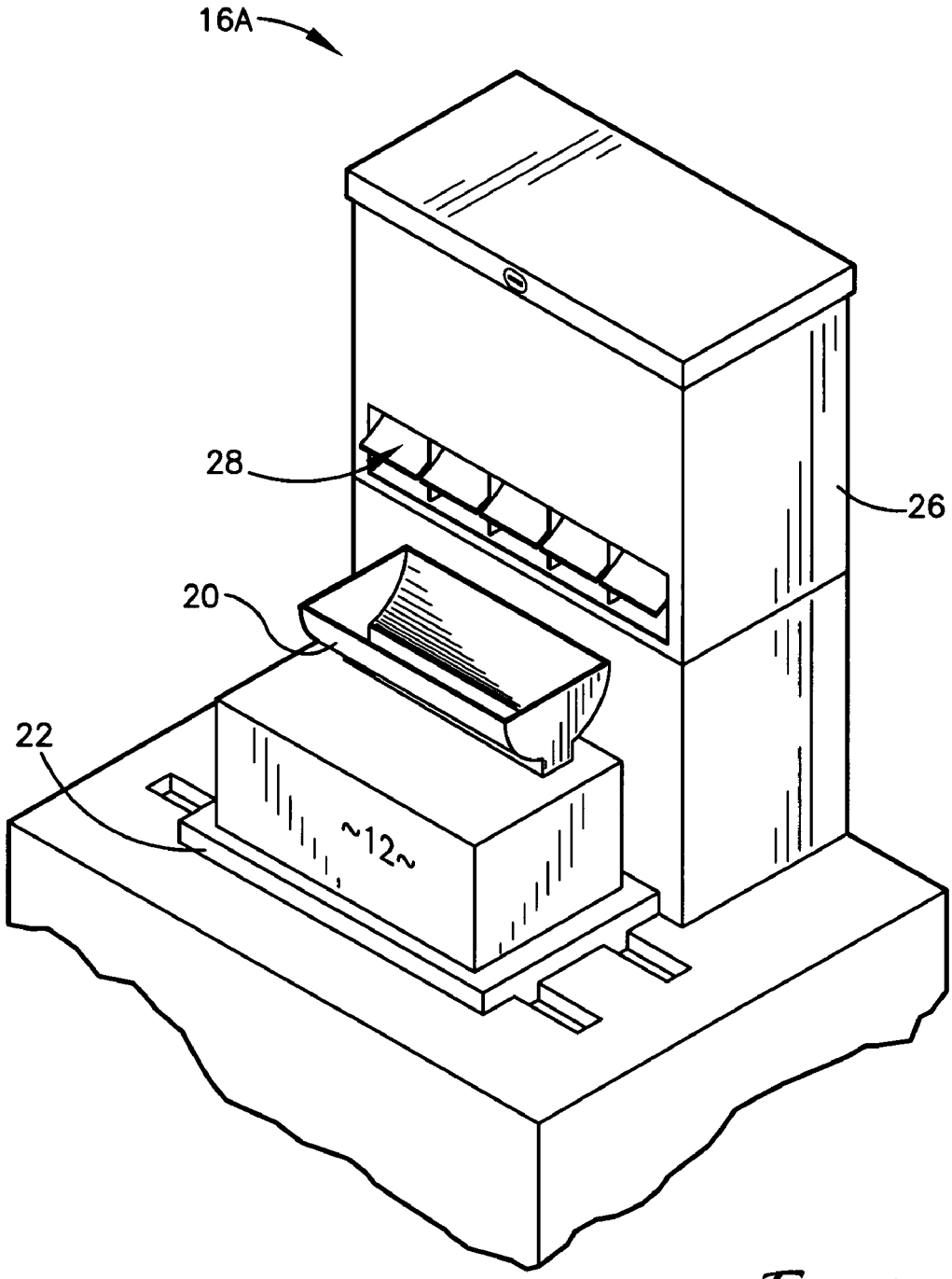
FIG. 5 is an isometric view of the funnel subcomponent and a canister carriage subcomponent for use with the first coin dispensing mechanism of FIG. 2.

Referring particularly to FIGS. 4 and 5, the funnel attachment 20 functions to adapt the first dispensing mechanism 16A to fill the canister 12 rather than the till 11. Such canisters are commonly used, for example, to substantially automatically dispense change at otherwise conventional checkout counters or to automatically dispense change from self-checkout systems. The funnel attachment 20 is preferably dimensioned so as to present a larger end 46 for receiving the coins directly from the coin dispensers 28 or from the exit ends 44 of the chutes 36, and a smaller end 48 that fits closely within or over a mouth of the canister 12 so as to ensure that the coins are deposited directly thereinto.

Referring particularly to FIG. 5, the canister carriage 22 is adapted to receive and retain the canister 12 in a proper or desired position for filling by the first dispensing mechanism 16A, and to facilitate moving the canister 12 so as to align it with each of the plurality of coin dispensers 28 or each of the exit ends 44 of the chutes 36. In one contemplated implementation, the canister carriage 22 is substantially automatically controlled by computer program, so that the canister 12 can be substantially automatically filled by the computer program moving the canister 12 beneath one of the coin dispensers 28 and then causing that coin dispenser 28 to release a pre-determined number of coins.

Figure 6:
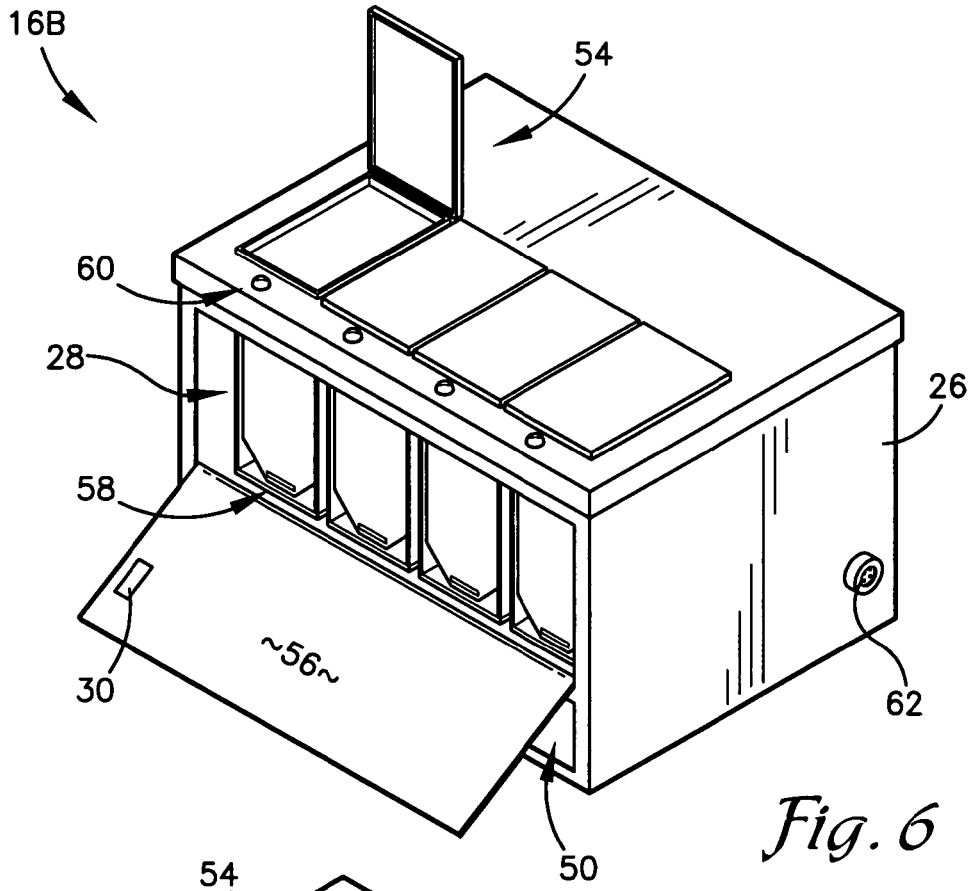
FIG. 6 is an isometric view of a second coin dispensing mechanism component for use with the system of FIG. 1, shown open for loading coins.
Figure 7:
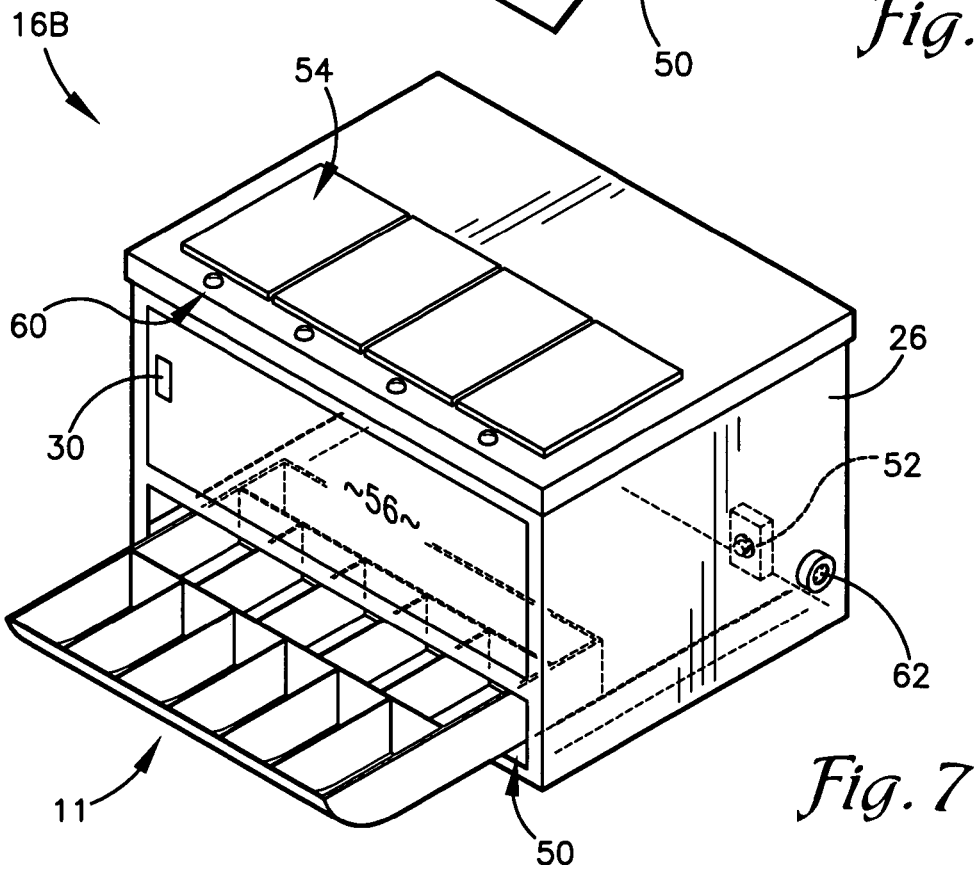
FIG. 7 is an isometric view of the second coin dispensing mechanism component of FIG. 6, shown in use.

The coin dispensing mechanism 16 may alternatively take the form of the second coin dispensing mechanism 16B, shown in FIGS. 6 and 7, which is specifically adapted for use with tills 11. Use of the second dispensing mechanism 16B rather than the first, eliminates the need to attach or remove till-accommodating components such as the chute attachment 18. The second dispensing mechanism 16B is substantially similar to the first but for the following differences. It should be noted, however, that any feature described herein in the context of a particular one of the dispensing mechanisms 16A,16B,16C may be incorporated into any of the other dispensing mechanisms 16A,16B,16C, as desired.

The housing 26 of the second dispensing mechanism 16B presents a slot 50 into which the till 11 is placed for filling. When the till 11 is properly positioned within the slot 50, each coin dispenser of the plurality of coin dispensers 28 is positioned substantially over a corresponding compartment of the till 11. A trigger 52 is located within the slot 50 and is activated by contact with or otherwise by the presence of the till 11 within the slot 50. Activation of the trigger 52 causes the coin dispensers 28 to release the coins into the till 11. The coin dispensers 28 are themselves accessed for filling via individual hinged doors 54; and accessed for removal via a single hinged panel 56. Each of the coin dispensers 28 is provided with one or more sensors 58 operable to detect coin jams and low coin stock. When coin stock is detected to be low for a particular one of the coin dispensers 28, an indicator 60, preferably in the form of an LED, activates to communicate the need to restock or add coins. A connection port 62 allows for communication with the computing device and the security system 24 via, for example, a serial connection, USB connection, network (LAN or WAN) connection, or wireless connection.

Figure 8:
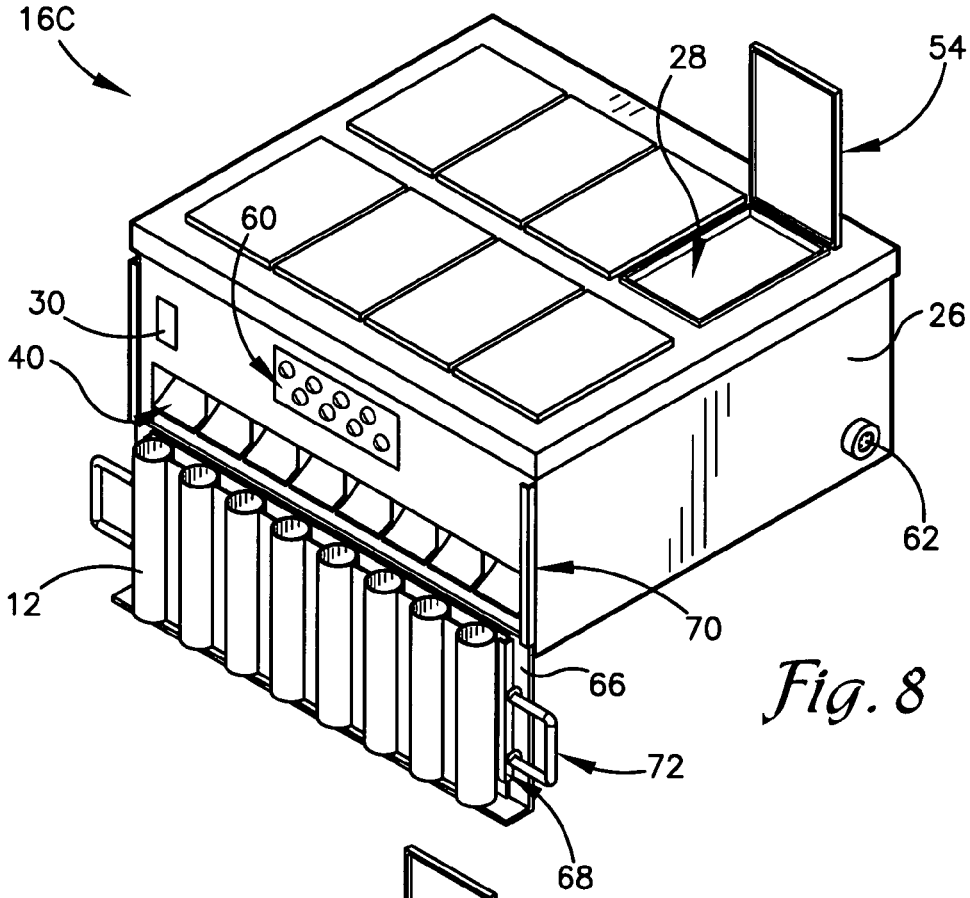
FIG. 8 is an isometric view of a third coin dispensing mechanism component for use with the system of FIG. 1, shown in use.
Figure 9:
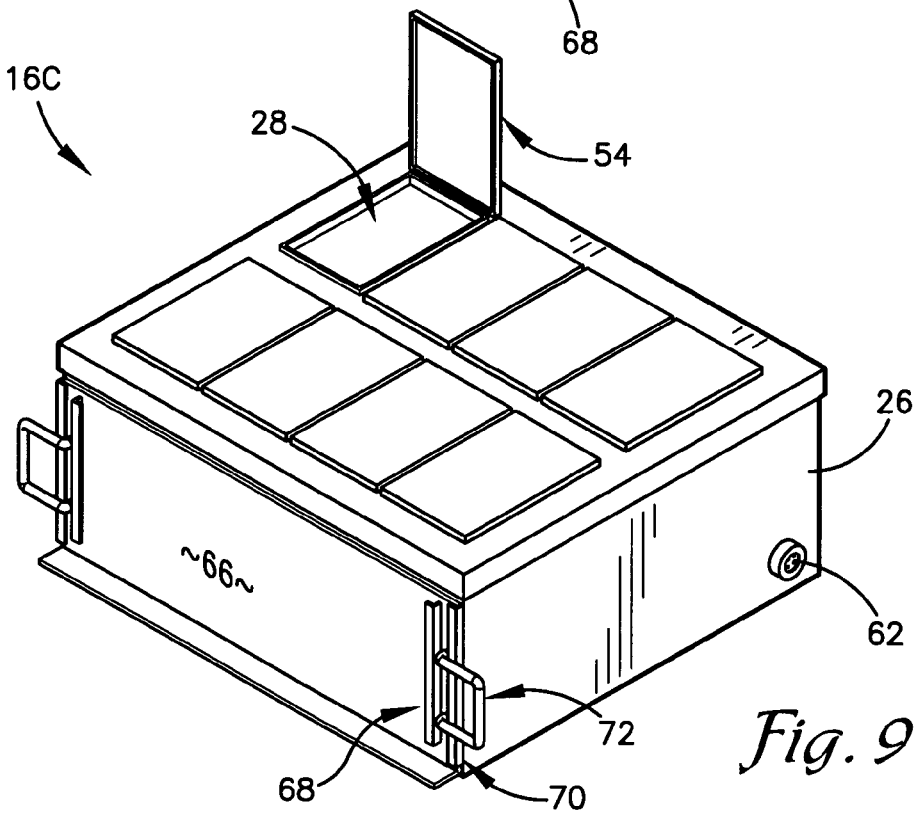
FIG. 9 is an isometric view of the third coin dispensing mechanism component of FIG. 8, shown closed.

The coin dispensing mechanism 16 may alternatively take the form of the third coin dispensing mechanism 16C, shown in FIGS. 8 and 9, which is specifically adapted for use with canisters 12. Use of the third dispensing mechanism 16C rather than the first, eliminates the need to attach or remove cannister-accommodating components such as the funnel attachment 20 or the cannister carriage 22. The third dispensing mechanism 16C is substantially similar to the first but for the following differences. Again, it should be noted that any feature described herein in the context of a particular one of the dispensing mechanisms 16A,16B,16C may be incorporated into any of the other dispensing mechanisms 16A,16B,16C, as desired.

The housing 26 of the third dispensing mechanism 16C presents a slidable face portion 66 onto or against which the canister 12 is placed and secured for filling. When the slidable face portion 66 is in a lowered position and the canister 12 is secured thereto using spring-biased or other suitable securement mechanisms 68, the canister 12 is properly positioned for filling. An internal manifold comprising a plurality of fixed slide portions 40 otherwise identical to those described above may be used to direct coins from the plurality of coin dispensers 28 into corresponding compartments of the canister 12. When finished filling the canister 12, the slidable face portion 66 may be slidably moved into a raised position whereby at least one avenue of access to the coin dispensing mechanisms 28 is cut off. In addition to increasing security, the raised position also facilitates moving and storing the third dispensing mechanism 16C. One or more rails 70 may be used accomplish this sliding movement, and one or more handles 72 may be incorporated into the slidable face portion 66 to facilitate raising and lowering.

The security package 24 enhances security of the dispensing mechanism 16 and coins loaded therein by allowing for monitoring by a closed circuit television (CCTV) system or by the computing device 12 adapted to record video images of the dispensing mechanism 16 or particular portions thereof in order to address any concerns relating to pilferage. In one implementation, the security package 24, rather than monitoring and recording continuously, is adapted to monitor and record only while the housing 26 is unsecured or while the chutes 36 of the first dispensing mechanism 16A are lowered, while the trigger 52 of the second dispensing mechanism 16B is actuated, or while the slidable face portion 66 of the third dispensing mechanism 16C is lowered, thereby providing a video record of all persons who access or use the dispensing mechanism 16 and their activities while doing so.

Figure 10:
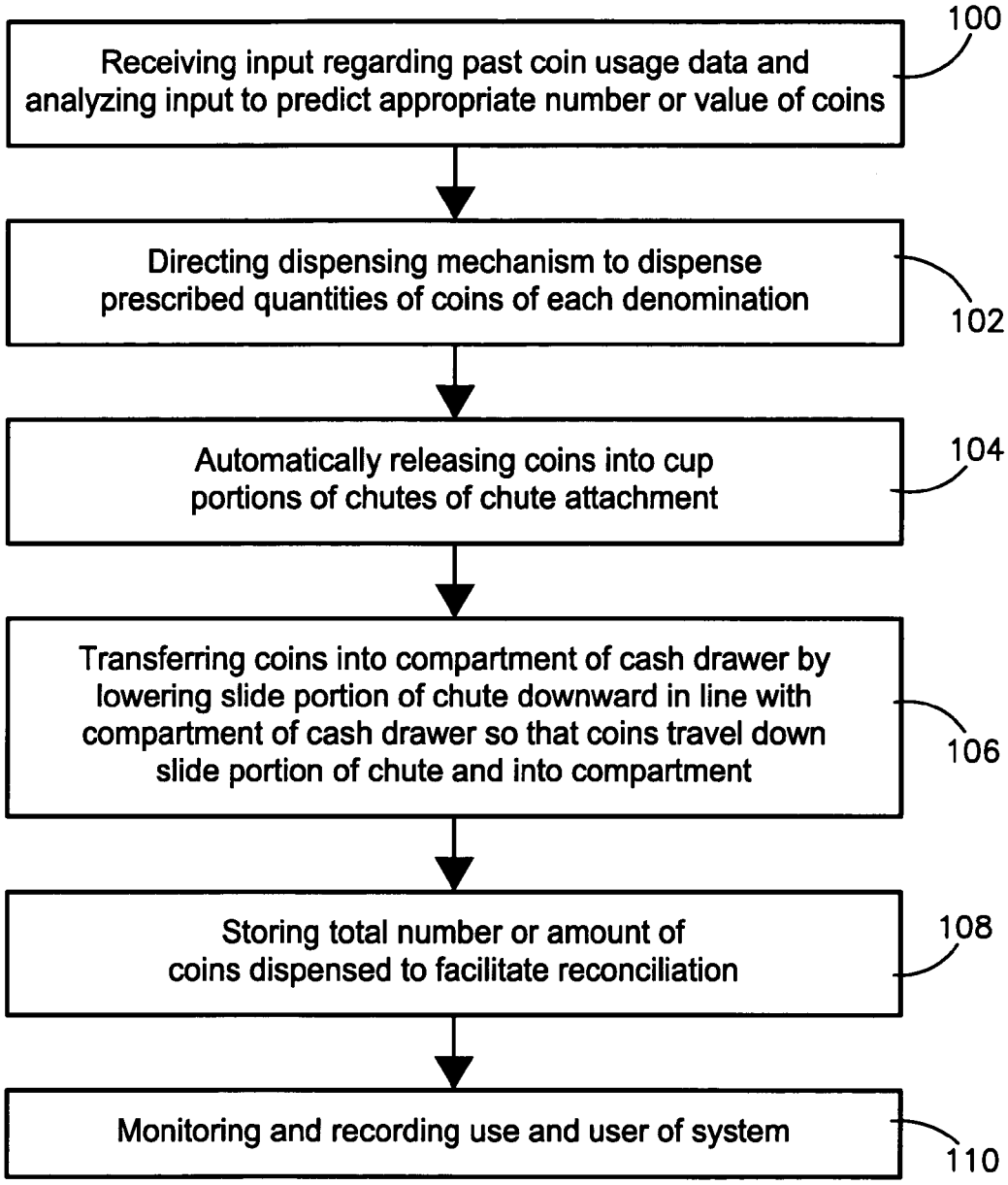
FIG. 10 is a flowchart of steps involved in operation of the system of FIG. 1 using the first coin dispensing mechanism of FIG. 2.

By way of illustration and not limitation, exemplary use of the system 10 may proceed as follows. This particular example is based on use of the first dispensing mechanism 16A, but either of the other two dispensing mechanisms 16B,16C described herein may be used instead. Referring to FIG. 10, the system 10 may be used, for example, to substantially automatically determine and load a number or value of coins of each of a plurality of different denominations into an appropriate compartment of a till 11. It will be appreciated that, typically, a cashier or clerk will receive a clean or new till at the start of a shift and after any break, and will return the used till prior to any break and at the end of the shift. Thus, the number of dispensed coins must be sufficient to last for the length of time, typically between two and three hours but potentially as long as five hours or more, between receiving the new till and returning the used till.

In order to accomplish this goal, the computer program receives data regarding past coin usage and analyzes this data to more accurately predict an appropriate number or value of coins that will allow the cashier or clerk to conduct business and make change for the required length of time, as depicted in box 100. Once the appropriate numbers are determined, the computer program directs the dispensing mechanism 16 to dispense the prescribed quantities of coins of each denomination, as depicted in box 102. These coins are automatically released from the coin dispensers 28 into the cup portions 38 of the chutes 36 of the chute attachment 18, as depicted in box 104. When the cashier or clerk is ready to transfer the coins from one of the chutes 36 into a compartment of the till 11, he or she lowers the slide portion 40 of the chute 36 downward in line with the compartment of the till 11 so that the coins travel down the chute 36 and into the compartment, as depicted in box 106. The computer program stores the total number or amount of coins dispensed, as depicted in box 108, thereby facilitating later reconciliation. During the dispensation process, the security package 24 may be monitoring and recording the system 10 and cashier or clerk, as depicted in box 110.

Additionally or alternatively, the system 10 may be used, for example, to substantially automatically determine and load a number or value of coins of each of a plurality of different denominations into a canister 12 in automated dispensing machinery. Such canisters are commonly transparent or have transparent portions and present graduation markings that facilitate visually determining the number or value of coins remaining in the canister. Construction of the canister 12 may proceed in a manner that is substantially similar or identical to the above-described process for constructing tills.

It is also contemplated, however, that the dispensing mechanism 16 may be incorporated into a fully-automated self-checkout system itself so that the canister 12 can be replenished seemlessly and without disruption to its operation and use by customers. To accomplish this goal, an operator of the system 10 visually determines the number or value of coins required to fill the canister 12, and then enters that amount into the computer program. If the operator is located remotely from the dispensing mechanism 16 or otherwise cannot see the graduation markings, then a video camera may be positioned so as to generate an image of the canister 12 that can be transmitted to a computer monitor or other display device associated with the computing device 14 for viewing by the operator. In an alternative implementation, the process is substantially automated by including sensors that allow the computing device 14 to determine for itself the number or value of coins needed, or sending the image from the video camera to the computing device 14 and including a routine or subroutine for determining, based on the image, the number or value of coins needed. Quantities may be determined by a communications link to the self-checkout systems which provides information regarding the number of coins remaining or the number of coins that have been dispensed. Once provided with the number or value of coins needed, the computing device 14 provides appropriate electronic signals to the dispensing mechanism 16 to release the necessary number or value of coins. The computing device 14 may also control the canister carriage 22 to substantially automatically move the canister 12 in order to, as necessary, align it with each of the plurality of coin dispensers 28.

Additionally, whether constructing or replenishing tills 11 or canisters 12, the system 10 may also be used to reconcile or facilitate reconciling each cashier, clerk, or self-checkout system with his, her, or its sales or transaction totals. This function is readily accomplished with appropriate routines or subroutines in the computer program. For example, the aforementioned computer program disclosed and described in the pending U.S. non-provisional patent application titled "REVENUE BALANCING METHOD AND COMPUTER PROGRAM", Ser. No. 09/616,401, filed Jul. 14, 2000, is able or readily adaptable to perform this function.

From the preceding description, it will be appreciated that the method of the present invention provides a number of distinct advantages over the prior art, including, for example, providing for substantially automated and controlled coin dispensation and reconciliation that substantially increases efficiency and reduces time and labor costs associated with constructing or replenishing tills or canisters for self-checkout systems. Furthermore, by analyzing past coin usage data to determine an appropriate number or amount of coins to dispense, the system substantially reduces time and labor costs associated with coin shortages and resulting loans or purchases of coins by cashiers during their shifts. Additionally, the system advantageously further improves efficiency by linking the processes of dispensation and reconciliation and treating them as necessary corollaries rather than wholly independent activities.

Although the invention has been described with reference to the preferred embodiment illustrated in the attached drawing figures, it is noted that equivalents may be employed and substitutions made herein without departing from the scope of the invention as recited in the claims. For example, as noted above, the computer program may be implemented in hardware, firmware, software, or any combination thereof, and is not limited to the computer program disclosed and described in the identified U.S. patent. Also, as mentioned, any of the features described herein in the context of a particular one of the dispensing mechanisms-may be incorporated into any of the other dispensing mechanisms, as desired.

Furthermore, it is contemplated that, depending on application and implementation, a single instance of the dispensing mechanism may be located in a secure cash room or other centralized location where the tills are rebuilt or the canisters refilled, or a separate instance of the dispensing mechanism may be located at each cash register or incorporated into each automated self-checkout system.

The present invention also offers substantial advantages where the cashier's till is supplemented by a substantially-automated coin dispensing machine at the cashier's station. In the prior art, the coin stock or inventory of the coin dispensing machines was considered part of the cashier's till, requiring that this coin stock be balanced or reconciled along with the till when changing cashiers. This is a cumbersome and highly impractical procedure, however, and it is much more desirable to balance or reconcile the cashier's till without having to balance and reconcile the coin stock of the coin dispensing machine.

A feature of the present invention is to consider this coin stock or inventory as part of the safe or store operating funds rather than the cashier's till. This is achieved by having the computer program, which tracks the amount of change dispensed by the coin dispensing machine, add the amount of change dispensed to the record of the cashier's till to be accounted for at the time of balancing or reconciliation. Thus, the amount of change dispensed is automatically added to the cashier's till record as though that change had been issued to the cashier as part of the new till. This advantageously eliminates any need to balance or reconcile the coin stock or inventory remaining in the coin dispensing machine whenever there is a cashier change.

Figure 11:
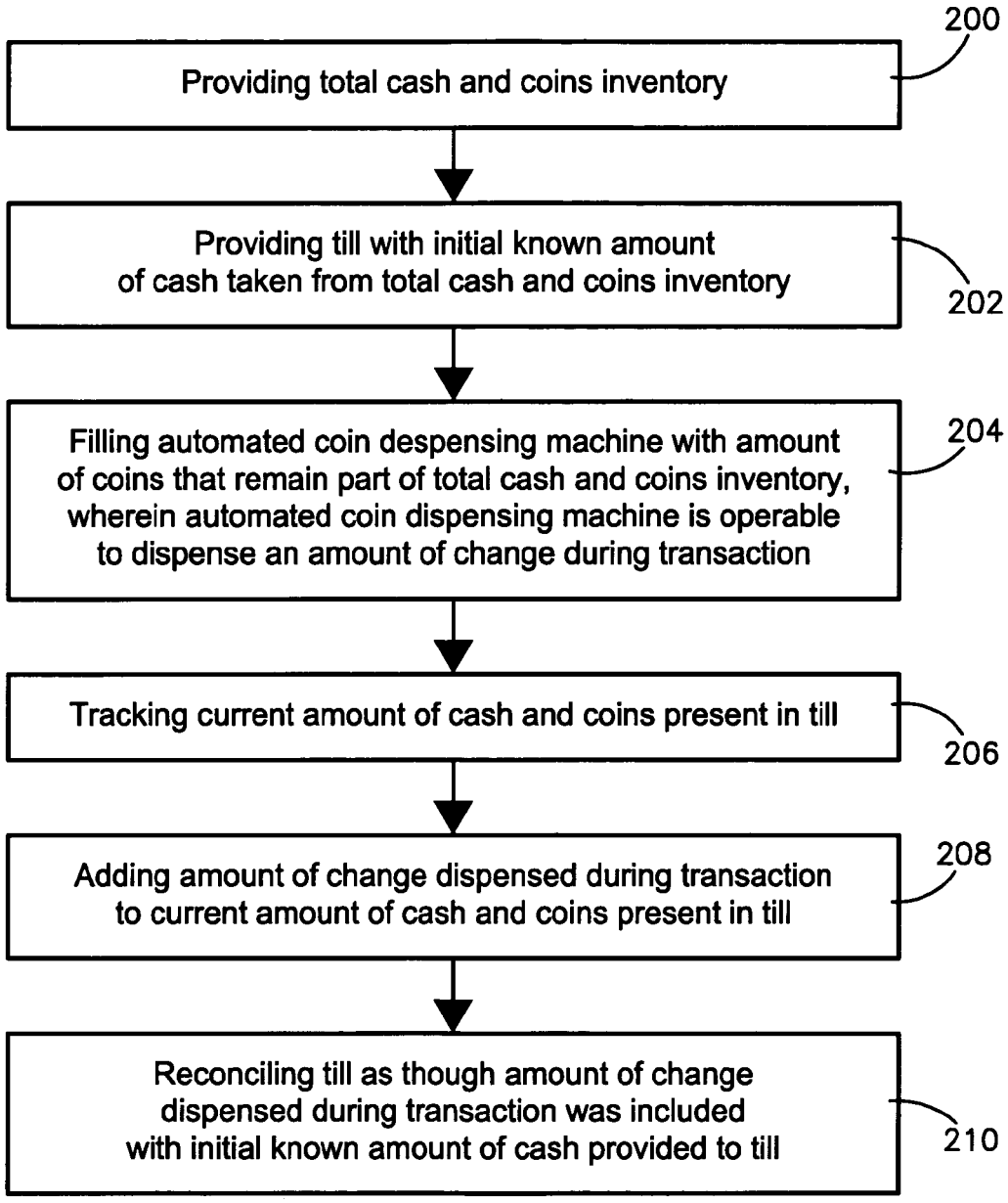
FIG. 11 is a flowchart of additional steps involved in operation of the system of FIG. 1.

More specifically, referring to FIG. 11, this method may proceed substantially as follows. The total cash and coins inventory is provided as the store operating fund, as depicted in box 200. Each till is then constructed with an initial known amount of cash taken from the fund, as depicted in box 202, and each automated coin dispensing machine is filled with an amount of coins that, as an accounting matter, remain part of the fund, as depicted in box 204. During the cashier's shift, the computer program tracks the current amount of cash and coins present in the till at all times, as depicted in box 206. Any coins dispensed by the automated dispensing machine during a transaction are added to the current amount of cash and coins present in the till, as depicted in box 208. At the end of the shift, the till is reconciled as though the coins dispensed by the automated dispensing machine during the shift were included with the initial known amount of cash provided to the till, as depicted in box 210. Furthermore, because coins loaded into the automated dispensing machines are considered part of the store operating fund, they need not be counted prior to loading or loaded into canisters, but can instead be dumped into hoppers within the machines.

A related feature of the present invention is to track not only the amount of change dispensed by the coin dispensing machine, but to track the denominations dispensed so that the computer program can communicate a warning when it determines that a particular denomination is running low and needs to be restocked. Thus, flexibility and control is enhanced both in balancing/reconciliation and replenishment, allowing for comprehensive coin management.

Additionally, in order to further facilitate reconciliation, each rebuilt till or canister may be provided with a unique identifier, possibly in the form of a bar code, to allow for tracking and identification.

Having thus described the preferred embodiment of the invention, what is claimed as new and desired to be protected by Letters Patent includes the following:

The invention claimed is:

1. A dispensing mechanism for dispensing coins into a canister, the dispensing mechanism comprising:

a housing having a slidable face portion for receiving and maintaining the canister in position for filling, wherein the slidable face portion is movable between a lowered position for filling the canister and a raised position;

a coin dispenser removably located within the housing and adapted to receive, store, and dispense the coins, with the coin dispenser being associated with a particular coin denomination, wherein, when the canister is maintained on the slidable face portion in position for filling, the coin dispenser releases the coins into the canister;

a sensor associated with the coin dispenser and adapted to determine when the coins stored within the dispenser need to be replenished; and an indicator associated with the sensor and adapted to communicate that the coins stored within the dispenser need to be replenished.

2. The dispensing mechanism as set forth in claim 1, wherein the slidable face portion includes a spring-biased securement mechanism for maintaining the canister in position for filling.

3. The dispensing mechanism as set forth in claim 1, wherein the slidable face portion includes one or more handles to facilitate moving the slidable face portion between the lower position and the raised position.

4. The dispensing mechanism as set forth in claim 1, further including a controller adapted to substantially automatically control an amount of coins to be dispensed by the coin dispenser.

5. The dispensing mechanism as set forth in claim 4, wherein the controller is adapted to receive input relating to past coin usage, analyze the input to predict future coin usage, and transmit a control signal to the coin dispenser to control dispensation of the coins based at least on part on the predicted future coin usage.

6. The dispensing mechanism as set forth in claim 4, wherein the controller is further adapted to maintain a record of each dispensation of the coins to facilitate reconciliation.

7. The dispensing mechanism as set forth in claim 1, further including a security package adapted to allow for monitoring and recording images of the dispensing mechanism.

8. The dispensing mechanism as set forth in claim 7, wherein the security monitors and records images of the dispensing mechanism only when the dispensing mechanism is dispensing the coins.

9. The dispensing mechanism as set forth in claim 1, further including a code scanner for reading identifying codes.

10. A system for dispensing coins into a canister, the system comprising:

a controller adapted to substantially automatically determine an amount of coins to be dispensed into the canister;

a dispensing mechanism including:

a housing having a slidable face portion for receiving and maintaining the canister in position for filling, wherein the slidable face portion includes a spring-biased securement mechanism for maintaining the canister in position for filling, and wherein the slidable face portion is movable between a lowered position for filling the canister and a raised position, a coin dispenser removably located within the housing and adapted to receive, store, and dispense the coins, with the coin dispenser being associated with a particular coin denomination, wherein the controller controls dispensation of the coins by the coin dispenser, so that when the canister is maintained on the slidable face portion in position for filling, the coin dispenser releases the coins into the canister, a sensor associated with the coin dispenser and adapted to determine when the coins stored within the dispenser need to be replenished, and an indicator associated with the sensor and adapted to communicate that the coins stored within the dispenser need to be replenished; and a security package adapted to allow for monitoring and recording images of the dispensing mechanism.

11. The system as set forth in claim 10, wherein the controller is adapted to receive input relating to past coin usage, analyze the input to predict future coin usage, and transmit a control signal to the coin dispenser to control dispensation of the coins based at least on part on the predicted future coin usage.

12. The system as set forth in claim 10, wherein the controller is further adapted to maintain a record of each dispensation of the coins to facilitate reconciliation.

13. The system as set forth in claim 10, wherein the slidable face portion includes one or more handles to facilitate moving the slidable face portion between the lower position and the raised position.

14. The system as set forth in claim 10, wherein the security monitors and records images of the dispensing mechanism only when the dispensing mechanism is dispensing the coins.

* * * * *